US012049836B2

(12) United States Patent
Schober et al.

(10) Patent No.: US 12,049,836 B2
(45) Date of Patent: Jul. 30, 2024

(54) VALVE STEM SEAL COMPRISING A VALVE ROTATING DEVICE

(71) Applicant: FEDERAL-MOGUL VALVETRAIN GMBH, Barsinghausen (DE)

(72) Inventors: Dirk Schober, Uetze (DE); Frank Zwein, Burscheid (DE); Florian Ringeling, Hannover (DE); Thorsten Matthias, Garbsen (DE); Stefan Kellermann, Barsinghausen (DE)

(73) Assignee: Federal-Mogul Valvetrain GmbH, Barsinghausen (DE)

( * ) Notice: Subject to any disclaimer, the term of this patent is extended or adjusted under 35 U.S.C. 154(b) by 0 days.

(21) Appl. No.: 18/550,620

(22) PCT Filed: Nov. 16, 2021

(86) PCT No.: PCT/EP2021/081803

§ 371 (c)(1),
(2) Date: Sep. 14, 2023

(87) PCT Pub. No.: WO2022/194407

PCT Pub. Date: Sep. 22, 2022

(65) Prior Publication Data

US 2024/0141810 A1 May 2, 2024

(30) Foreign Application Priority Data

Mar. 16, 2021 (DE) ..... 102021106307.8

(51) Int. Cl.

| | |
|---|---|
| ***F01L 1/32*** | (2006.01) |
| ***F01L 3/08*** | (2006.01) |
| ***F01L 3/10*** | (2006.01) |

(52) U.S. Cl.
CPC ..... *F01L 1/32* (2013.01); *F01L 3/08* (2013.01); *F01L 3/10* (2013.01)

(58) Field of Classification Search
CPC ..... F01L 1/32; F01L 3/08; F01L 3/10
USPC ..... 123/90.28, 90.37, 90.67
See application file for complete search history.

(56) References Cited

U.S. PATENT DOCUMENTS

| | | | | |
|---|---|---|---|---|
| 4,470,383 A | | 9/1984 | Debolt | |
| 5,775,284 A | * | 7/1998 | Kirchner | F01L 3/08 123/188.6 |
| 6,119,645 A | * | 9/2000 | Hesher | F01L 3/10 123/188.6 |

(Continued)

FOREIGN PATENT DOCUMENTS

| | | |
|---|---|---|
| CA | 2298222 A1 | 8/2000 |
| DE | 3128086 A1 | 2/1983 |

(Continued)

*Primary Examiner* — Jorge L Leon, Jr.
(74) *Attorney, Agent, or Firm* — Robert L. Stearns; Dickinson Wright PLLC

(57) ABSTRACT

A valve rotating device with valve stem seal includes a valve rotating device, with a cylinder head rest and a spring rest intended to bear against a valve spring during operation. The valve rotating device is designed to rotate the spring rest relative to the cylinder head rest during operation. A valve stem seal is attached to the cylinder head rest of the valve rotating device. The valve stem seal being designed to bear against a valve stem and to seal same during rotational and axial movements.

15 Claims, 6 Drawing Sheets

(56) References Cited

U.S. PATENT DOCUMENTS

| | | | | |
|---|---|---|---|---|
| 6,244,235 | B1 * | 6/2001 | Hegemier | F01L 3/08 123/188.6 |
| 6,901,902 | B1 * | 6/2005 | Butcher | F16K 41/08 123/188.6 |
| 2008/0157482 | A1 * | 7/2008 | Zoppi | F16J 15/3236 277/502 |
| 2017/0058724 | A1 | 3/2017 | Katsumata | |
| 2020/0347755 | A1 * | 11/2020 | Wolking | F16K 29/02 |

FOREIGN PATENT DOCUMENTS

| | | | | |
|---|---|---|---|---|
| JP | 2020169586 | A | 10/2020 | |
| WO | WO-2004109067 | A1 * | 12/2004 | F01L 1/32 |

* cited by examiner

VALVE STEM SEAL COMPRISING A VALVE ROTATING DEVICE

BACKGROUND

1. Technical Field

The present invention relates to a valve stem seal that is intended to seal off a valve stem in an internal combustion engine against a cylinder head, wherein the valve stem seal is further combined with a valve rotating device that rotates the valve by a small angle about its longitudinal axis on each actuation.

2. Related Art

Valve stem seals are used on the one hand to prevent oil passing through the gap between the valve stem and the valve guide into the intake duct or the exhaust duct of the engine and being burnt there, resulting in oil being wasted and exhaust limit values being adversely affected. Valve stem seals are also intended to prevent combustion gases passing via the exhaust duct and the gap between the valve stem and the valve guide into the cylinder head, where they contaminate the oil or increase a pressure in the oil circuit.

Valve stem seals per se are already known from various applications. Valve stem seals are used to protect the intake duct and the exhaust duct in the cylinder head from the ingress of oil into the intake tract and exhaust tract and to protect the oil circuit from contamination from the intake tract and exhaust tract. Usually, flaps are provided here, which are attached to the valve guides and press a seal against a valve stem. The most important object consists in preventing oil in the cylinder head from passing into the engine or combustion chamber in upright engines.

Likewise known are valve rotating devices, which are based on a combination of balls, springs and sloping planes and are preferably arranged at an upper end of a valve. Valve rotating devices with a spring design are likewise known. These are usually combinations of a disc spring with multiple rolling elements that roll on sloping planes and rotate the valve a little about the stem axis of the valve stem when the valve opens, so that the valve disc is rotated by a few degrees relative to the valve seat on every opening, as a result of which one-sided wear of the valve seat and the valve disc is prevented. The conventional valve rotating device is usually attached at the top in the region of the valve spring disc. Further types of valve rotating devices are known in the form of Rotocoil™ or else Rotocap™ valve rotating devices.

SUMMARY

The present invention is based on the object of improving a component, which was previously intended only for a single problem, to the extent that multiple partial problems can be solved simultaneously with said component.

The present invention makes it possible to combine previously separate components in one unit and thus to reduce outlay on storage, handling and installation in internal combustion engines. The manufacturing outlay will be below the combined manufacturing outlay for the individual parts. An increased integration of the components can be achieved here, which additionally allows savings in materials and resources.

A valve rotating device having a valve stem seal is provided. The valve rotating device comprises a cylinder head rest, which is intended to bear against or lie on a cylinder head. The valve rotating device further comprises a spring rest, which is intended to bear against at least one valve spring and support it in the direction of the cylinder head during operation. The valve rotating device is designed to rotate the spring rest relative to the cylinder head rest during operation, in particular when the valve is actuated, in particular when the valve opens. The rotation of the at least one valve spring on a base causes this rotation to be transmitted to a valve stem end via a spring disc bearing against the top of the spring. When the valve opens, the valve is rotated about the valve stem, because the valve disc lifts off from the valve seat of the cylinder head and is no longer blocked in the rotation direction by a force fit. The valve rotating device is characterized in that a valve stem seal is attached to the cylinder head rest of the valve rotating device and is designed to bear against a valve stem and seal same during rotational and axial movements of the valve and valve stem.

In the basic design, the valve rotating device is only provided with a seal on the valve stem but not with a seal opposite a valve guide or the cylinder head. The sealing effect in this case is achieved simply by a certain viscosity of the engine oil between the cylinder head rest and the cylinder head in combination with the spring force of the valve spring pressing the cylinder head rest onto the cylinder head. In this case, a static sealing effect can also be achieved without a separate seal as long as the gap dimensions, surface quality and the pressing force from the valve spring are sufficient.

In a further exemplary embodiment of the valve rotating device, it comprises another seal, which is designed to seal off the cylinder head rest in the axial direction; this seal can also be referred to as a cylinder head rest seal. In this case, an axial seal can be provided, which seals an underside of the cylinder head rest against the cylinder head. In this case, the entire underside of the cylinder head rest can be provided with a thin elastomer layer or an elastomer coating, for example. A relatively small pressing force can be used to achieve a sufficient sealing effect without the need for a particularly complicated sealing geometry or a particularly elaborate sealing lip. It is likewise possible to introduce or inlay a seal acting in the axial direction in a corresponding depression or groove in an underside of the cylinder head rest, with which a higher surface pressure and a compression limit of the seal can be achieved easily.

A special form of this seal can be designed as a seal that is effective in the axial direction and acts in the axial direction against an end face of a valve stem guide. This embodiment has the advantage that the valve stem seal and the seal acting on the end face of the valve stem guide or the valve stem guide end face seal can be formed integrally. Furthermore, this embodiment allows a very small sealing space to be produced, as a result of which the space between the valve stem seal and the valve stem guide end face seal can be kept very small so that a counterpressure builds up very rapidly in this space, so that a fluid flows upwards between the valve stem and the valve stem guide from an exhaust duct or an intake duct. This is a simple and compact embodiment of the present invention, which seals off the gap both from the valve stem and from the cylinder head. In this case, the force of the valve spring helps to achieve a sufficient sealing effect, while a desired defined compression of the seal can be achieved via a distance from a contact face.

In an additional exemplary embodiment of the valve rotating device with valve stem seal, it further comprises a seal designed to seal off the cylinder head rest against a lateral face of a valve stem guide. The seal can also be referred to as a valve stem guide lateral face seal. Here, the seal is designed as a radial seal, which in addition to this can be designed to center the cylinder head rest in relation to the valve stem guide. The layout makes it possible to achieve a desired compression of the seal very easily. This embodiment can also be combined with the valve stem guide end face seal.

An additional embodiment of the valve rotating device with valve stem seal also comprises a seal designed to seal off the cylinder head rest radially to the outside. This outer radial seal can be used when depressions are provided in the cylinder head for bearing against the valve springs or the valve rotating devices. This embodiment has the advantage that the seal can center the cylinder head rest very easily relative to the valve stem even with relatively small dimensions. It is likewise possible to implement this embodiment by means of an O-ring, which is inserted into a corresponding groove in an outer face of the valve rotating device or the cylinder head rest of the valve rotating device.

In another exemplary embodiment of the valve rotating device with valve stem seal, the rotating device comprises at least one disc spring, rolling elements and springs and at least one rolling or sliding bearing. These components are conventionally provided in valve rotating devices. The rolling elements are usually arranged on a sloping plane and can roll against a spring rest and rotate it further by an angle range on actuation. It is also possible for rolling elements that only execute a tilting movement to be provided.

In a further embodiment of the valve rotating device with valve stem seal, a spring rest face of the spring rest is provided with an anti-rotation means for the valve spring. Preferably, an associated valve spring disc for fastening to the valve stem end is likewise provided with an anti-rotation means for the valve spring. This can ensure that the rotation produced by the valve rotating device is also actually transmitted to the valve. In this embodiment, a situation can be excluded in which the valve spring slips relative to the spring rest or the valve disc and only the spring rest or the valve spring but not the valve itself is rotated.

The above-described embodiments relate to a valve rotating device that is arranged between the cylinder head and the valve spring. In the following, embodiments that are arranged between the valve spring and a valve stem end are mainly described. In this case, the designations valve spring disc and valve stem fastening are used instead of spring rest and cylinder head rest.

According to a further aspect of the present invention, a valve rotating device having a valve stem seal is provided wherein a valve rotating device is provided with a spring rest or a spring disc and a valve stem fastening. The valve stem fastening is designed to be fastened to a valve stem end during operation, for example with collets, wherein this connection is intended to be frictional or force-fitting, preferably even form-fitting, in the circumferential direction. The valve rotating device is designed to rotate the valve stem fastening relative to the spring disc during operation. The valve rotating device is provided on the valve stem fastening of the valve rotating device with a valve stem seal, which is designed to form a seal against a valve stem. In this embodiment, only the valve stem fastening is intended to be sealed off against a valve stem. In the basic design, for example, the connection between the valve stem fastening and the valve stem can thus be improved. The valve stem seal can in this case be designed as a static seal, since no movements are supposed to occur between the valve stem fastening and the valve stem.

In a further embodiment of the valve rotating device with valve stem seal, it further comprises a seal designed to seal off the valve stem fastening against a lateral face of a valve stem guide. This seal can also be referred to below as a valve stem guide seal. In this case, the seal is designed as a radial seal, which allows displacement both in the axial direction and in the circumferential direction. The movement of the valve stem fastening relative to the cylinder head must in this case be absorbed by the valve stem guide seal. The valve stem guide seal can be designed in contrast as a radial inner seal or as a radial outer seal.

In the embodiment as a radial inner seal, the valve stem guide seal encloses the valve stem guide from the outside and slides up and down against this outer face. This can require a type of bushing or a tube attachment on the valve stem fastening. In this case, the length and the shape of the valve stem guides of the engine should be adapted to this type of sealing.

In the embodiment as a radial outer seal, the valve stem guide seal should act on a lengthened tube attachment on the valve stem guide and seal the latter inwards. However, this embodiment requires the use of adapted valve stem guides that have a circular cylindrical outer face in the region of the sealing but has the advantage that the seal can be designed to lie closer to a valve axis, since the valve stem guides can be formed with a smaller wall thickness in the region of the seal.

According to a further aspect of the present invention, a valve rotating device having a valve stem seal is provided, wherein a valve rotating device is provided with a spring rest or a spring disc and a valve stem fastening. The valve stem fastening is designed to be fastened to a valve stem end during operation, for example with collets, wherein this connection is intended to be frictional or force-fitting, preferably even form-fitting. The valve rotating device is designed to rotate the valve stem fastening relative to the spring disc during operation. The valve rotating device is provided on the spring disc with a valve stem seal, which is designed to form a seal against a valve stem. In this embodiment, only the spring rest is intended to be sealed against a valve stem. In the basic design, for example, the connection between the spring rest and the valve stem can thus be improved. The valve stem seal is used here substantially as a radial shaft seal, which must absorb rotational movements and small axial movements. In this case, the valve stem seal seals off the rotational movements of the valve. The valve stem seal must likewise be able to absorb the axial part of the working stroke of the valve rotating device but not of the entire valve. Here, the valve stem seal can easily be arranged so as to displace in the axial direction in order to allow a seal relative to radial movements between the spring rest and the valve stem.

In a further embodiment of the valve rotating device with valve stem seal, it further comprises a seal designed to seal off the spring rest against a lateral face of a valve stem guide. This seal can also be referred to below as a valve stem guide seal. In this case, the seal is designed as a radial seal, which must allow displacement in the axial direction only. In this case, the movement of the spring rest relative to the cylinder head must be absorbed by the valve stem guide seal, which corresponds substantially to the entire valve stroke. The valve stem guide seal can be designed as a radial inner seal or as a radial outer seal, wherein the radial seal that bears against the outer face of the valve guide is preferred.

In the embodiment as a radial inner seal, the valve stem guide seal encloses the valve stem guide from the outside and slides up and down against this outer face. This can require a type of bushing or a tube attachment on the valve stem fastening.

In the embodiment as a radial outer seal, the valve stem guide seal should act on a widened tube attachment on the valve stem guide and seal the latter inwards. However, this embodiment requires the use of adapted valve stem guides but has the advantage that the seal can be designed to lie closer to a valve axis.

This embodiment allows the two seal components to be separated so that a simple radial shaft seal can be combined with an axial movement seal.

In an additional embodiment of the valve rotating device with valve stem seal, the valve stem seal is provided with at least one spring that presses the valve stem seal radially inwards against a valve stem in order to improve the sealing effect of the valve stem seal. This spring can also be referred to as a valve stem seal spring and can be designed for example as a tubular spring. By means of the tubular spring, a constant sealing effect can be achieved largely independently of a current operating temperature. The valve stem seal spring can be manufactured from a metal such as steel, with which a radial force largely independent of the operating temperature can be generated even in cases in which an elastomer or a rubber material would exhibit a temperature-induced decrease in strength. In an additional embodiment of the valve rotating device with valve stem seal, the valve stem seal is provided with at least one spring that presses the valve guide seal radially inwards against a lateral face of a valve guide in order to improve the sealing effect of the valve stem seal. This spring can also be referred to as a valve guide seal spring and can be designed as a tubular spring. By means of the tubular spring, a constant sealing effect can be achieved largely independently of a current operating temperature. The valve stem seal spring can be manufactured from a metal such as steel, with which a radial force largely independent of the operating temperature can be generated even in cases in which an elastomer or a rubber material would exhibit a temperature-induced decrease in strength.

In a further embodiment of the valve rotating device with valve stem seal, a spring rest face of the spring rest or that of the spring disc is provided with an anti-rotation means for the valve spring. Preferably, an associated valve spring disc for fastening to the valve stem end or a corresponding rest face of the valve spring on the cylinder head is likewise provided with an anti-rotation means. This can ensure that the rotation produced by the valve rotating device is also actually transmitted to the valve. In this embodiment, a situation can be excluded in which the valve spring slips relative to the spring rest or the valve disc and only the spring rest or the valve spring but not the valve itself is rotated.

THE DRAWINGS

The present invention is illustrated below using schematic diagrams, which are not to scale, of different exemplary embodiments.

DETAILED DESCRIPTION

In the FIGURES, only the sectional plane itself is shown for all elements with the exception of the sloping planes and the valve spring, as a result of which a clearer view of the rotationally symmetrical components is achieved.

The same or similar reference signs are used both in the FIGURES and in the description to refer to the same or similar components or elements. Therefore, to keep the description concise, not all the elements in all the FIGURES are described individually if their function has already been described in a previous figure.

Figure 1A:
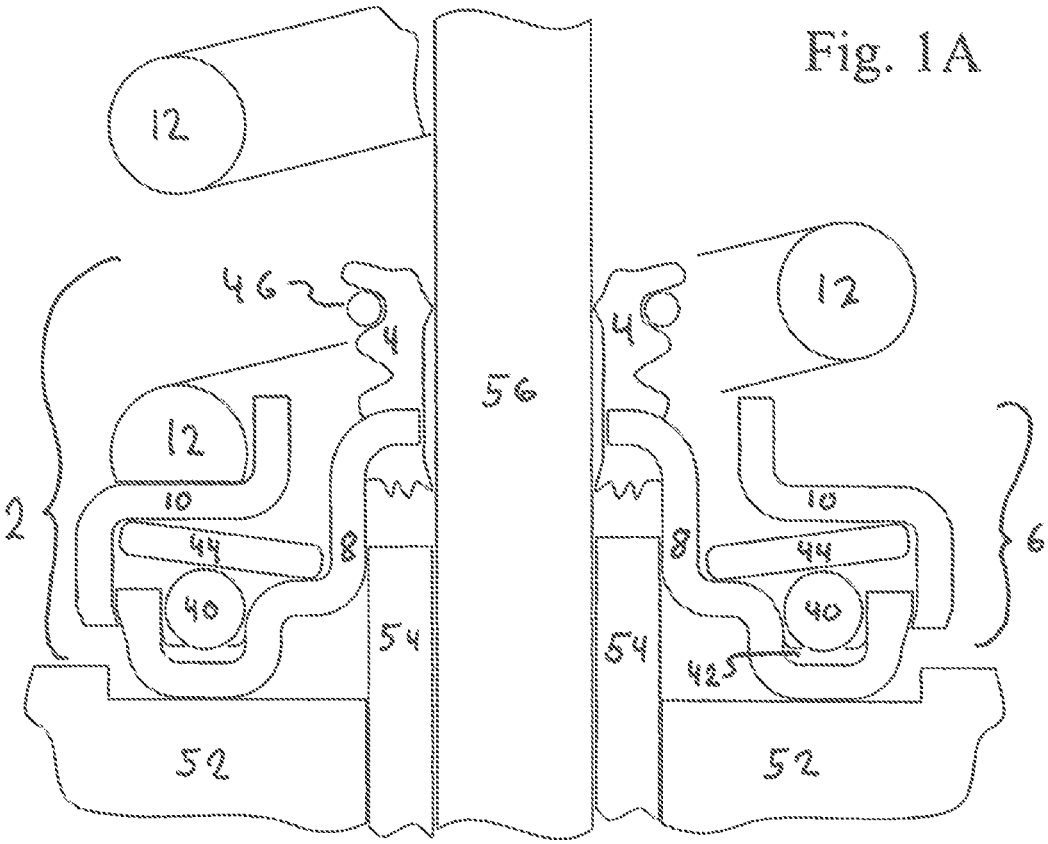
FIGS. 1A to 1E show different embodiments of the valve rotating device according to the invention having a valve stem seal, in which a part of a valve rotating device resting directly on a cylinder head provides the sealing.

FIG. 1A shows a partial sectional view through a cylinder head 52, at the point at which a valve stem 56 emerges from the top of the cylinder head. Between the cylinder head 52 and the valve stem 56 there is a valve stem guide, which can also be omitted, in particular in the embodiments of FIGS. 1A to 1D. Resting directly on the cylinder head 52 there is a valve rotating device with valve stem seal 2, on which a valve spring 12 is supported, which is connected to the valve stem end at the other end (not shown). The valve rotating device 6 is formed in the lower part of the valve rotating device with valve stem seal 2, and the valve stem seal 4 is molded on in the upper part. The valve rotating device 6 rests with the cylinder head rest 8 on the cylinder head 52. Sloping planes 42 are provided in the cylinder head rest 8, via which sloping planes rolling elements 40, shown here as balls, can roll. The rolling elements 40 are each pressed against the upper end of the sloping planes 42 by means of restoring springs (not shown). Above the cylinder head rest 8 there is a spring rest 10 on which the valve spring 12 rests. A disc spring 44 is also arranged between the cylinder head rest 8 and the spring rest 10 and keeps these two elements at a distance from one another. When the valve is actuated or opened, the valve spring 12 is first compressed until the force becomes great enough to compress the disc spring 44. When the disc spring 44 deforms, it lifts off from the cylinder head rest 8 on the inside and can roll over the sloping planes 42 via the rolling elements 40 counter to the force of the restoring springs. Here, this causes an anti-clockwise rotation of the valve spring 12, which is transmitted via the upper end of the valve spring 12 to the valve stem 56. This rotation can prevent a situation in which damage can have a greater effect at one point on the valve seat or on the valve disc.

In FIG. 1A, the cylinder head rest 8 rests fixedly on the cylinder head and is prevented from rotating by the force of the valve spring 12 thereon. The cylinder head rest 8 is further provided with a collar or a protrusion with which the cylinder head rest 8 and thus the entire valve rotating device 6 can be centred relative to the valve stem guide 54. A valve stem seal 4 of the cylinder head rest 8 is injection-molded to the top of the collar on the cylinder head rest 8 or the protrusion thereof. In FIG. 1A, the valve stem seal of the cylinder head rest or cylinder head rest valve stem seal 4 is reinforced by a seal spring 46, which makes it possible to achieve a uniform pressing pressure of the cylinder head rest valve stem seal 4 even at different operating temperatures. In the embodiment shown, a separate valve stem seal can then be omitted, since it was possible to combine these two elements in a more complex component. The cylinder head rest 8 is sealed off by a combination of the pressing pressure of the valve spring and a lubricant present in the cylinder head without the need for a separate seal. The integration of two components means that the number of parts needed, the costs for two different parts, and most of all the number of assembly processes during assembly of an internal combustion engine can be considerably reduced. It should primarily be noted that the valve stem guide 54 can also be made simpler, since an interface for mounting and holding a conventional valve stem seal no longer has to be provided. This can allow the wall thickness of the valve stem guide to be reduced in comparison with the conventional design. The present invention therefore not only creates the possibility of combining two components in one but also permits the entire cylinder head design to be revolutionized, if that is possible after over 100 years of development.

Figure 1B:
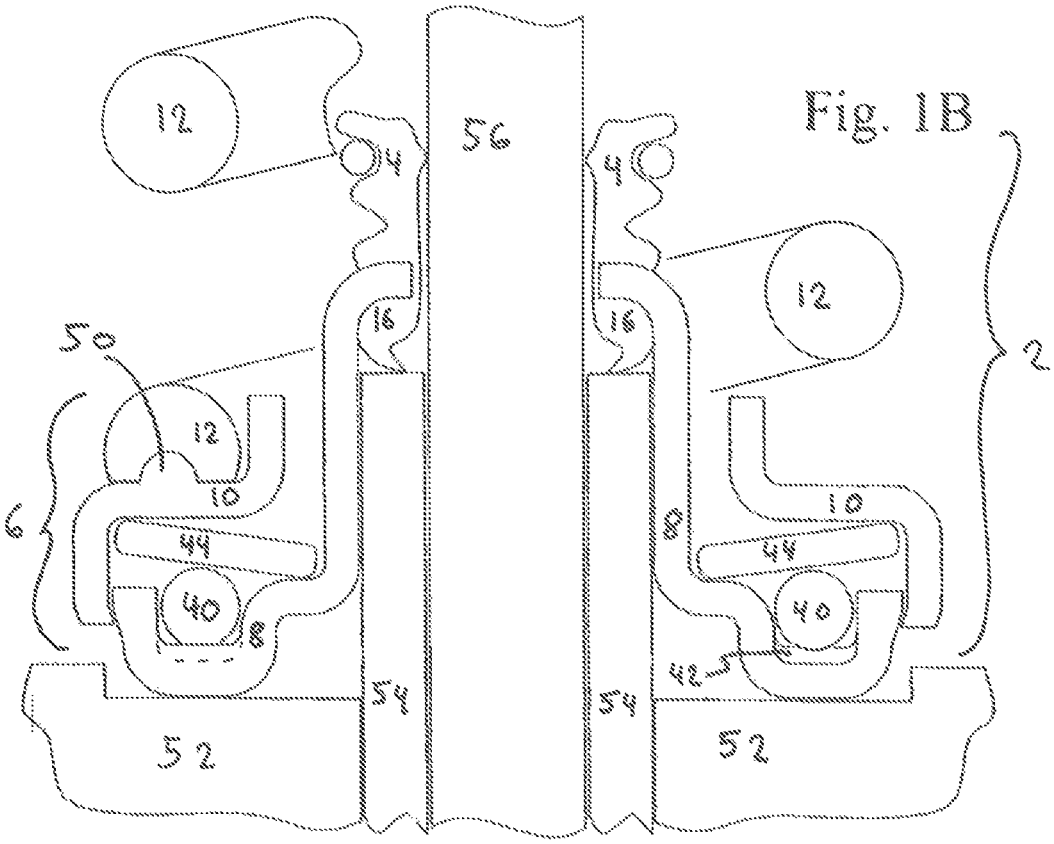

FIG. 1B shows an embodiment of the valve rotating device with valve stem seal 2 similar to that of FIG. 1A, wherein a valve stem guide seal or valve stem guide axial seal 16 is additionally provided and is supported at the top in the axial direction on the end face of the valve stem guide 54. By means of this embodiment, it is possible to keep a space between the cylinder head rest valve stem seal 4 and the valve stem guide axial seal 16 very small. Here, a counterpressure, which can effectively prevent further flow of fluids, can build up very rapidly, even if there is a slight leak between the valve stem guide 54 and the valve stem 56. In FIG. 1B, the valve stem guide 54 and the protrusion of the cylinder head rest 8 are larger or longer, which can result in advantages when guiding the valve stem 56. The function of the valve rotating device 6 corresponds to that of FIG. 1A.

Figure 1C:
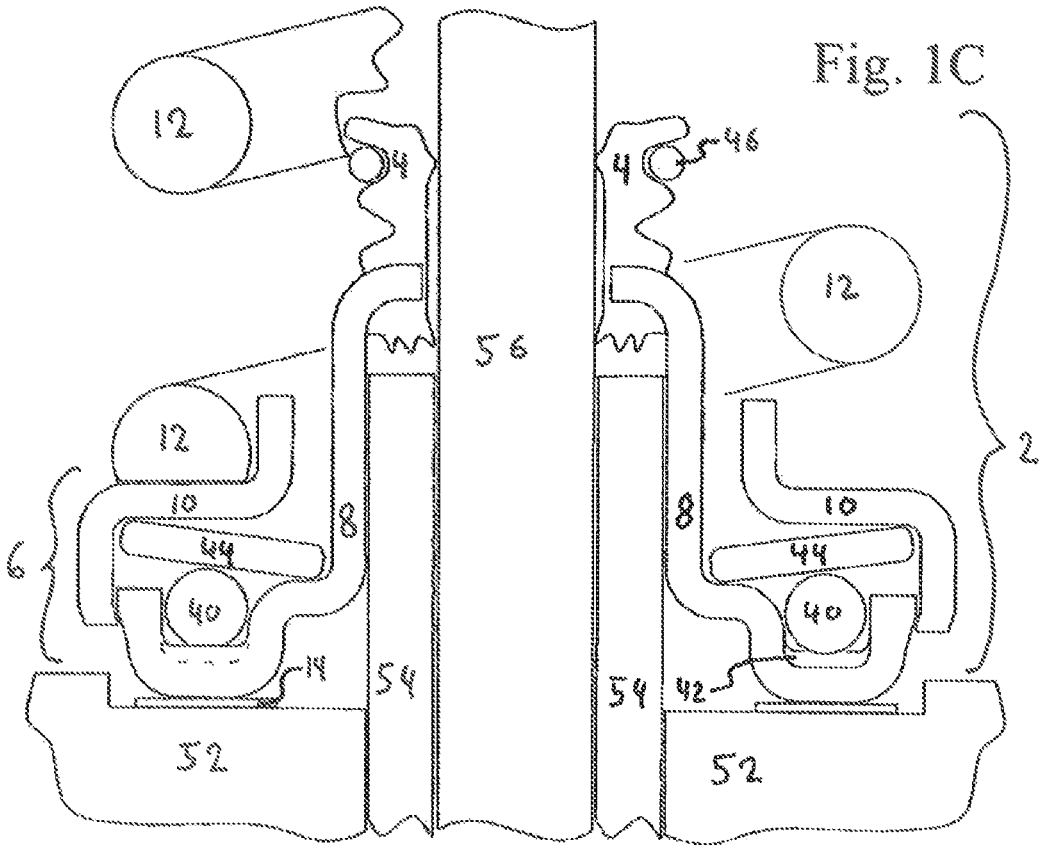

In FIG. 1C, the cylinder head rest 8 opposite the cylinder head 52 is provided with a cylinder head rest seal 14 in the form of a flat seal. Owing to the low tolerances and the low roughness on the cylinder head, the cylinder head rest seal 14 can be designed as a flat seal or else formed by a sealing coating or a thin elastomer layer. This embodiment corresponds substantially to FIG. 1A. Owing to the small thickness of the flat seal, relatively low requirements are made of the material of the cylinder head rest seal 14.

Figure 1D:
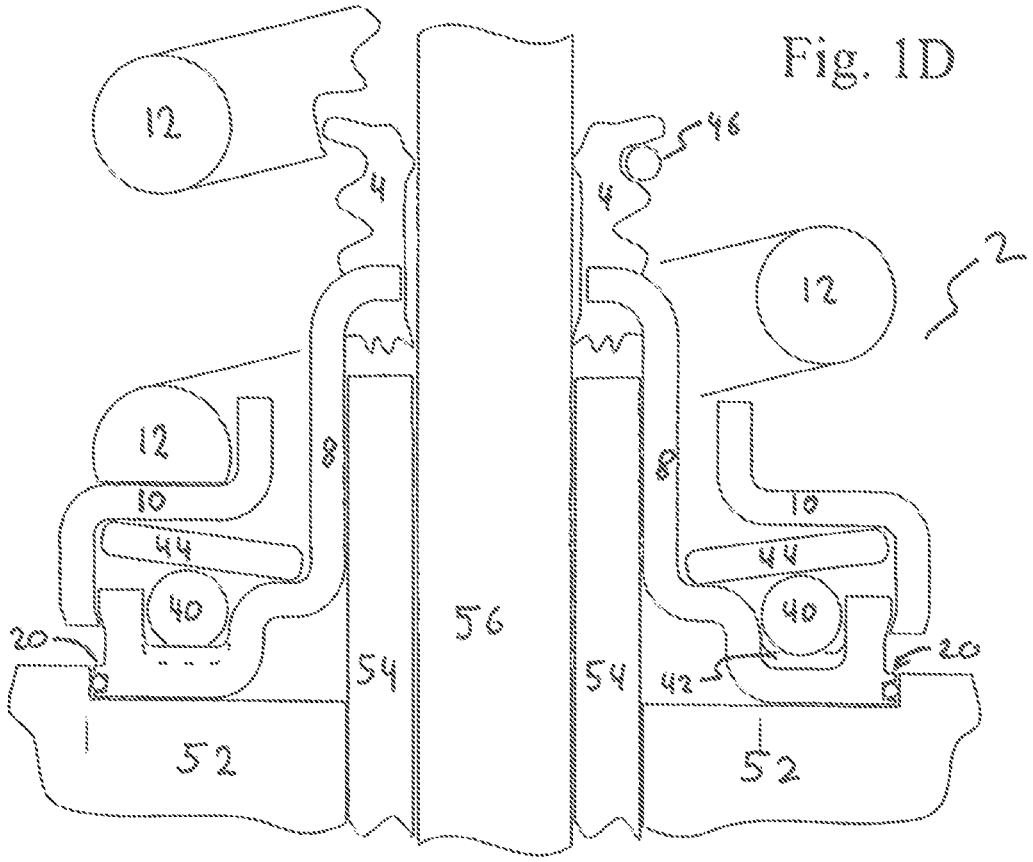

In FIG. 1D, the cylinder head rest 8 is provided on an outer side with a circumferential groove, in which an O-ring is laid as the cylinder head rest outer seal 20. O-rings are particularly suitable as a static seal when laid in an annular groove. After the O-ring is laid in the groove, its shape prevents it from being able to fall out of the groove. Thanks to the O-ring, the cylinder head rest 8 and thus the entire valve rotating device 6 can be centred in the cylinder head. Owing to the large diameter, it is also possible here for very low requirements to be made of the strength, since a corresponding load is distributed to the entire circumference and thus to a large area.

Figure 1E:
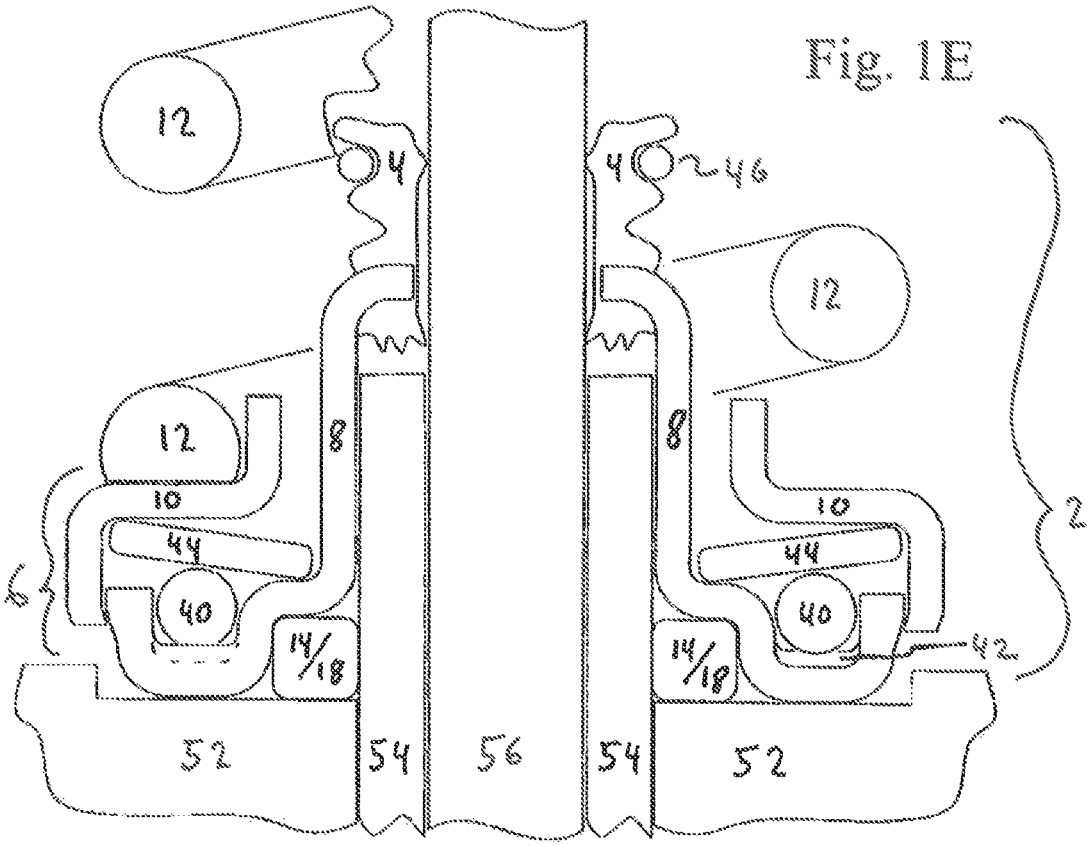

FIG. 1E largely corresponds to the embodiment of FIG. 1A, wherein the cylinder head rest seal is designed as a combination seal and is likewise used as a valve stem guide seal or valve stem guide radial seal 18. Here, the valve spring permits a radial seal by compression of the seal 14/18 in the axial direction by means of the valve spring 12.

In all embodiments of FIGS. 1B to 1E, the cylinder head rest seal 14 is designed as a static seal, which allows cost-effective manufacturing. In FIG. 1B, the valve stem seal 4 of the cylinder head rest 8 and the valve stem guide axial seal 16 are formed integrally, which is likewise possible in FIG. 1E with or without changing the embodiment. It is also envisioned to provide a combination of FIGS. 1B and 1E, wherein multiple seals are attached to the cylinder head rest. Multiple sealing lips can also be provided, and the entire design can differ from that shown.

Figure 2A:
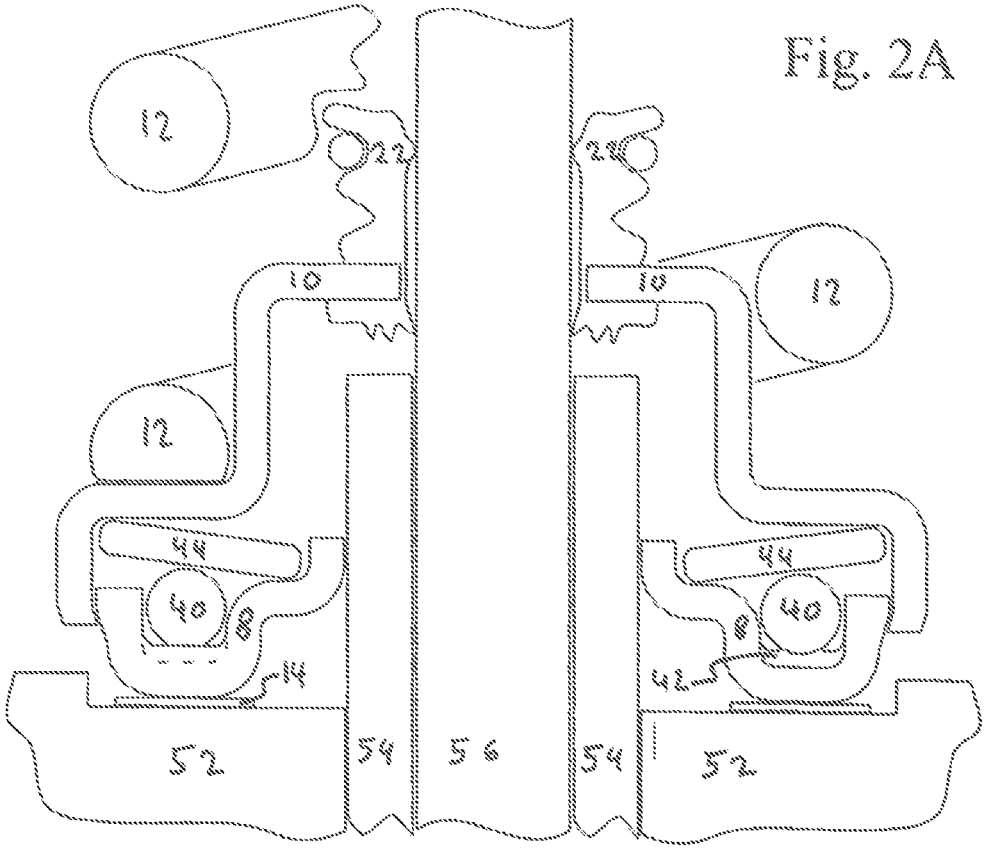
FIGS. 2A to 2C show valve rotating devices according to the invention with valve stem seals, in which a part of a valve rotating device directly connected to a valve spring provides the sealing.
Figure 2B:
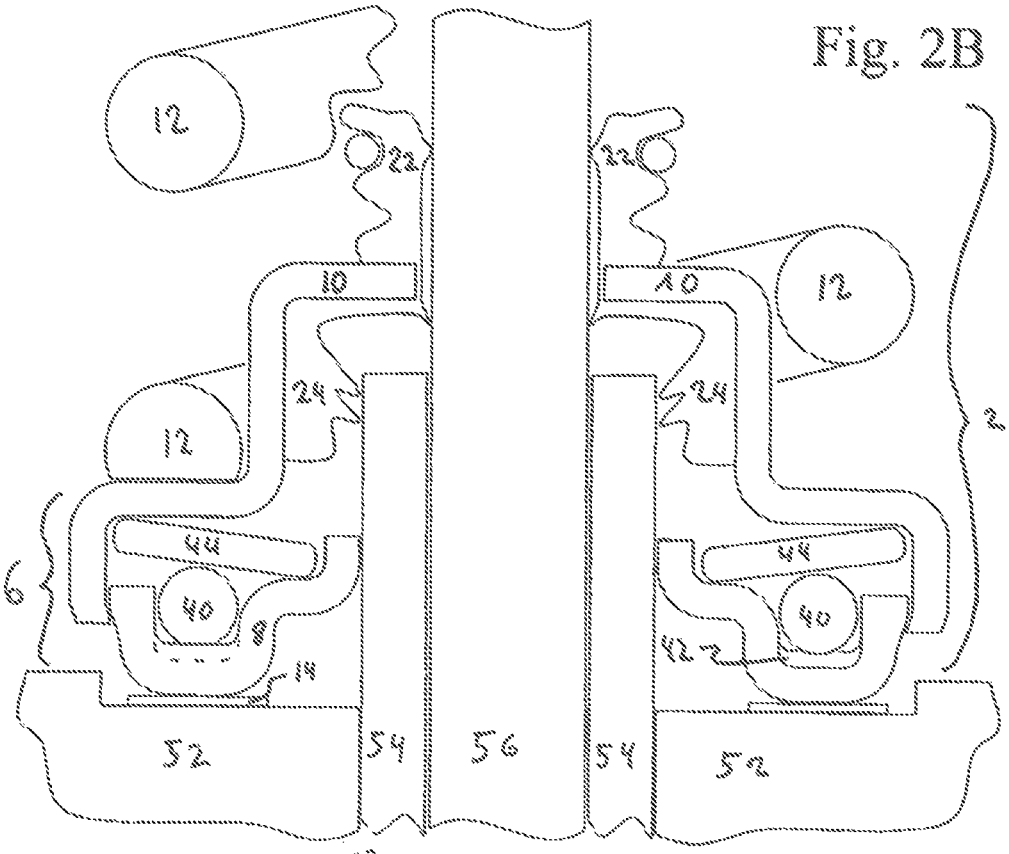
Figure 2C:
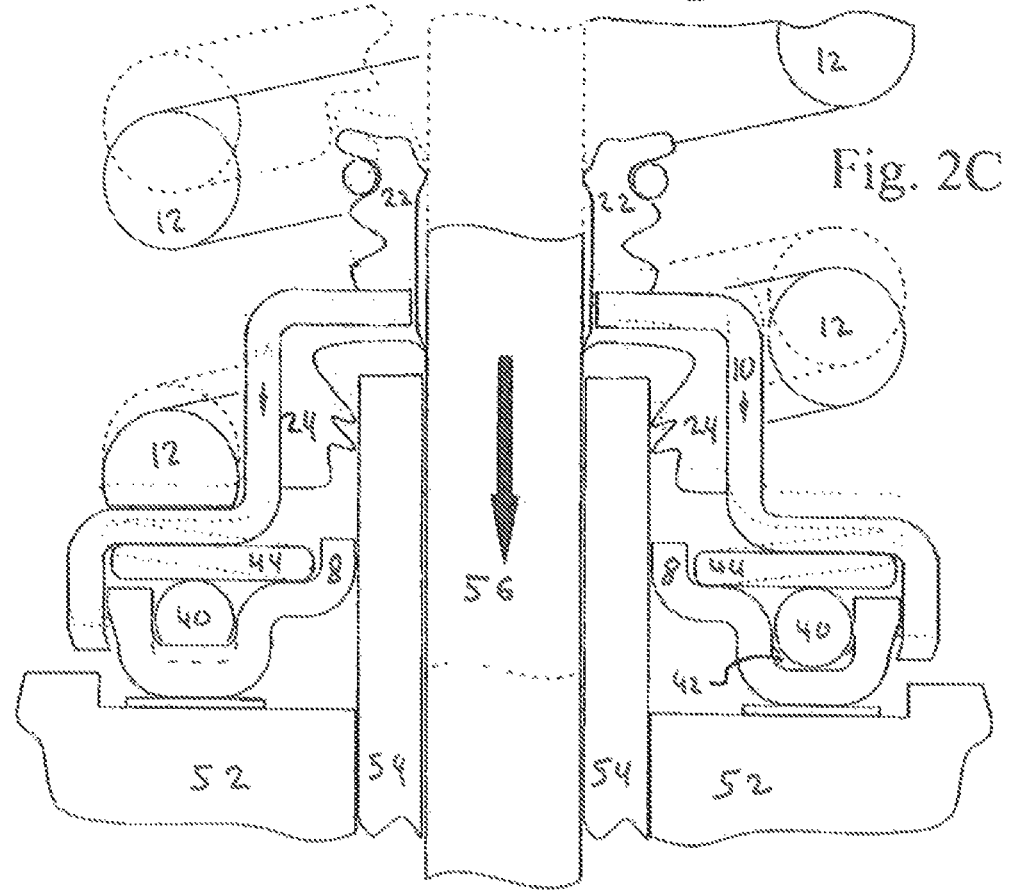

FIGS. 2A to 2C show a further embodiment in which the valve stem seal is not attached to the cylinder head rest but to the spring rest 10.

In FIG. 2A, the spring rest 10 is provided with a tubular protrusion, which lies around the valve stem guide 54 and protrudes upwards in the direction of the valve stem end, beyond same. A valve stem seal 22 of the spring rest 10 or spring rest valve stem seal 22 is cast on the protrusion of the spring rest 10. This seal can be provided with a seal spring 46, as shown. This embodiment differs in the fastening point of the valve stem seal 22. The valve stem seal 22 rotates with the valve spring 12 and the valve stem 56, as a result of which it becomes possible to design the seal as a simple seal for axial displacements. This makes it possible to use a sealing lip or a seal that can provide a translational sealing function but not a rotational sealing function. In the basic form, the gap between the spring rest 10 and the cylinder head rest 8 is achieved by the disc spring 44 and by the force with which the valve spring presses the cylinder head rest 8 against the cylinder head 52.

In FIG. 2A, another flat seal is provided between the cylinder head rest 8 and the cylinder head 52.

FIG. 2B shows a further embodiment in which, in contrast to the embodiment of FIG. 2A, a valve stem guide seal 24 of the spring rest 10 or a spring rest valve stem guide seal 24 is provided. The spring rest valve stem seal 22 can in this case be designed as a simple translational seal. However, the spring rest valve stem guide seal 24 must be able to seal both translationally and rotationally, wherein the translational movement is much smaller than the rotational one.

FIG. 2C is intended to illustrate the movement of the valve rotating device. The outlines of FIG. 2B are shown with dashed lines. The rolling elements 40 have rolled down the sloping planes of the cylinder head rest 8 and have shifted the spring rest 10 downwards and in the clockwise direction as viewed from above.

Figure 3:
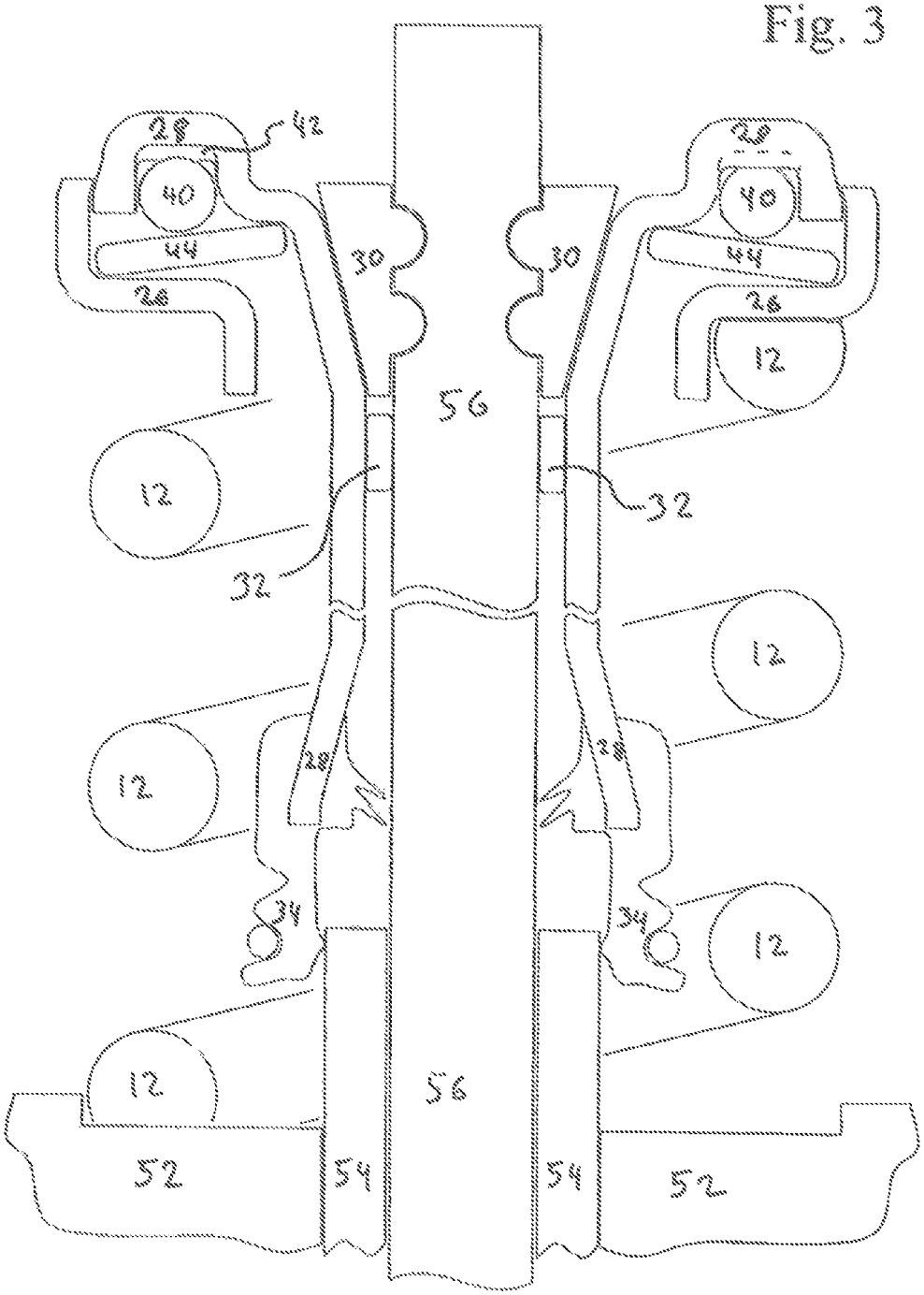
FIGS. 3 and 4 show valve rotating devices according to the invention having valve stem seals, in which the sealing is provided at the top on the valve stem end of a valve.

FIG. 3 shows an embodiment in which the valve rotating device 6 is arranged at the top between the valve stem end and the valve spring. The embodiment corresponds substantially to that of FIGS. 1A to 1E, wherein the protrusion is much longer and is sealed off both against the valve stem 56 and against the valve stem guide. Depending on the dimensions of the valve stem guide, this can also be advantageous in comparison with the embodiment with the valve rotating device at the bottom. In this case, the valve spring rest is formed by the valve spring disc, and the valve fastening corresponds to the cylinder head rest.

In FIG. 3, the valve fastening 28 rotates with the valve stem, for which reason a static seal can be used here for sealing between the valve fastening 28 and the valve stem 56. This embodiment is suitable in particular for engines having long valve stem guides that protrude a long way.

Figure 4:
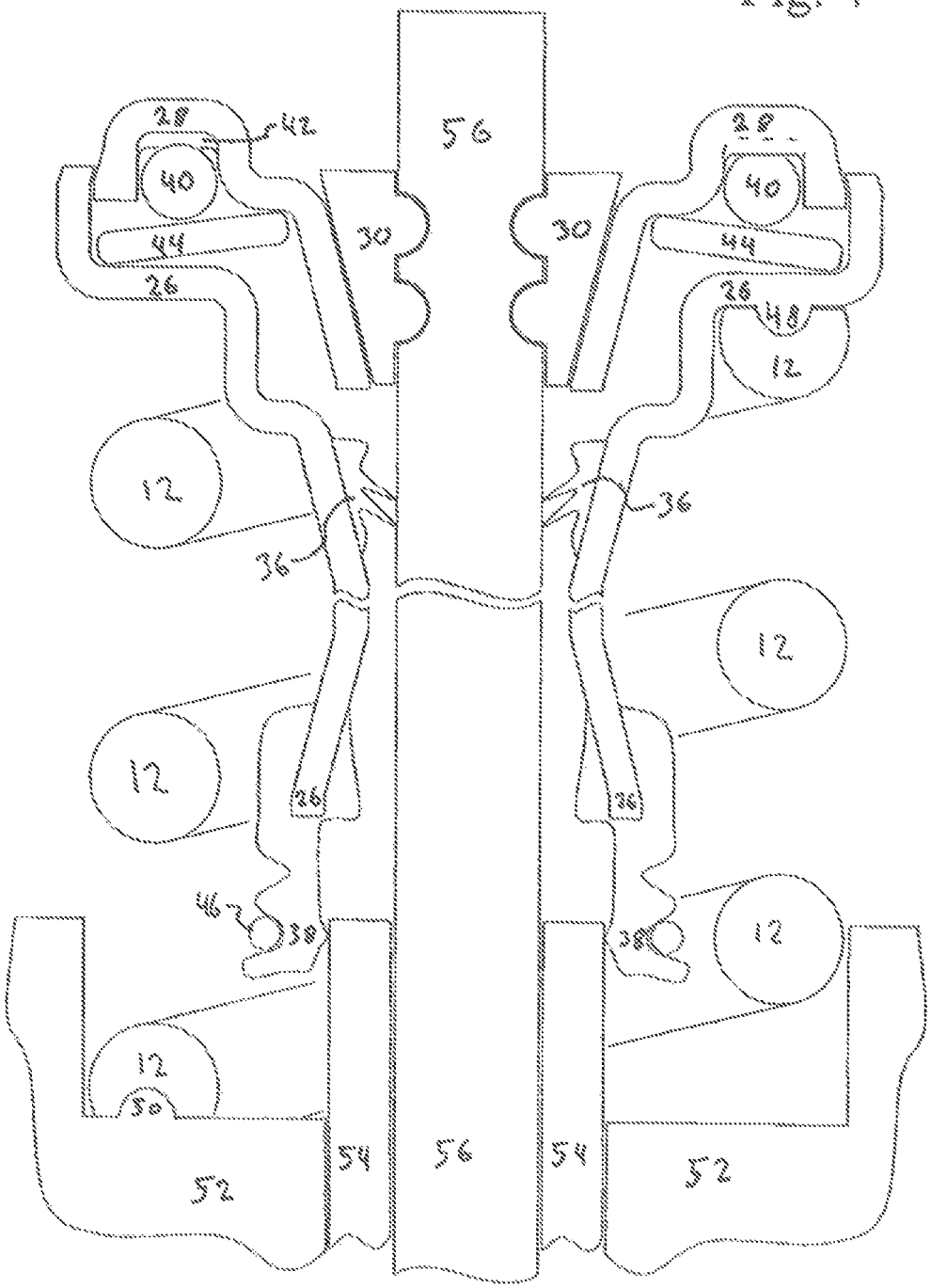

FIG. 4 corresponds substantially to the embodiment of FIG. 3 with the difference that on the one hand the seals are attached to the valve spring disc 26 and on the other hand there is no seal between the valve stem 56 and the valve fastening 28. This embodiment is also suitable in particular for engines having long valve stem guides that protrude a long way. In FIG. 4, the spring disc 26 is provided with an anti-rotation means 48 for the valve spring 12, and the rest face of the valve spring 12 on the cylinder head 52 is likewise provided with an anti-rotation means 50 for the valve spring 12, as a result of which a form-fitting connection is achieved between the valve disc and the cylinder head, via which the force generated by the rotating device 6 can be supported on the engine block.

The invention can be practiced otherwise than described in the above embodiments which are specific examples which are descriptive rather than limiting in nature. The invention is defined in the appended claims.

What is claimed is:

1. A valve rotating assembly for a gas-exchange valve of an internal combustion engine, the valve rotating assembly comprising:

a valve rotating device configured to bear against at least one valve spring during operation of the valve, the valve rotating device including a cylinder head rest, a spring rest, and a valve stem seal;

wherein the spring rest is configured to rotate relative to the cylinder head rest during the operation of the valve; and wherein the valve stem seal is attached to the cylinder head rest so as to bear against a valve stem of the valve, the valve stem seal configured to seal the valve stem during rotational and axial movements of the valve stem.

2. The valve rotating assembly according to claim 1, further comprising a cylinder head rest seal configured to seal the cylinder head rest against a face of a cylinder head of the engine.

3. The valve rotating assembly according to claim 1, further comprising a valve stem guide axial seal configured to seal the cylinder head rest against an axial end face of a valve stem guide of the engine.

4. The valve rotating assembly according to claim 1, further comprising a valve stem guide radial seal configured to seal the cylinder head rest against a lateral face of a valve stem guide of the engine.

5. The valve rotating assembly according to claim 1, further comprising a cylinder head rest outer seal configured to seal the cylinder head rest against a radial surface of a cylinder head of the engine.

6. The valve rotating assembly according to claim 1, wherein the valve stem seal includes at least one seal spring that presses the valve stem seal radially inwards against the valve stem.

7. The valve rotating assembly according to claim 1, wherein the valve rotating device further includes a disc spring, rolling elements, and springs.

8. The valve rotating assembly according to claim 7, wherein the valve rotating device further includes at least one rolling or sliding bearing.

9. The valve rotating assembly according to claim 1, wherein the spring rest includes an anti-rotation support configured to prevent a rotation of the at least one valve spring relative to the spring rest.

10. A valve rotating assembly for a gas-exchange valve of an internal combustion engine, the valve rotating assembly comprising:

a valve rotating device configured to bear against a valve spring during operation of the valve, the valve rotating device including a cylinder head rest, a spring rest, and a valve stem seal;

wherein the spring rest is configured to rotate relative to the cylinder head rest during the operation of the valve; and wherein the valve stem seal is attached to the spring rest so as to bear against a valve stem of the valve, the valve stem seal configured to seal the valve stem during rotational and axial movements of the valve stem.

11. The valve rotating assembly according to claim 10, further comprising a spring rest valve stem guide seal configured to seal the spring rest against a lateral face of a valve stem guide of the engine.

12. A valve rotating assembly for a gas-exchange valve of an internal combustion engine, the valve rotating assembly comprising:

a valve rotating device configured to be fastened to a valve stem end of the valve, the valve rotating device including a spring disc, a valve stem fastening, and a valve stem seal;

wherein the valve stem fastening is configured to rotate relative to the spring disc during operation of the valve; and wherein the valve stem seal is attached to the valve stem fastening so as to bear against a valve stem of the valve, the valve stem seal configured to seal the valve stem during rotational and axial movements of the valve stem.

13. The valve rotating assembly according to claim 12, further comprising a valve stem guide seal configured to seal the valve stem fastening against a lateral face of a valve stem guide of the engine.

14. A valve rotating assembly for a gas-exchange valve of an internal combustion engine, the valve rotating assembly comprising:

a valve rotating device configured to be fastened to a valve stem end of the valve, the valve rotating device including a spring disc, a valve stem fastening, and a valve stem seal;

wherein the valve stem fastening is configured to rotate relative to the spring disc during operation of the valve; and wherein the valve stem seal is attached to the spring disc so as to bear against a valve stem of the valve, the valve stem seal configured to seal the valve stem during rotational and axial movements of the valve stem.

15. The valve rotating assembly according to claim 14, further comprising a valve stem guide seal attached to the spring disc so as to seal the spring disc against a lateral face of a valve stem guide of the engine.

* * * * *